US009650817B2

(12) United States Patent
Patel

(10) Patent No.: US 9,650,817 B2
(45) Date of Patent: May 16, 2017

(54) DEFORMABLE OUTSIDE HANDLE REAR HOOK OR PLUNGER

(71) Applicant: Ford Global Technologies, LLC, Dearborn, MI (US)

(72) Inventor: Rajesh K. Patel, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 396 days.

(21) Appl. No.: 13/804,358

(22) Filed: Mar. 14, 2013

(65) Prior Publication Data

US 2014/0265370 A1 Sep. 18, 2014

(51) Int. Cl.

| | |
|---|---|
| ***E05B 85/10*** | (2014.01) |
| ***E05B 77/02*** | (2014.01) |
| ***E05B 85/16*** | (2014.01) |
| ***E05B 17/00*** | (2006.01) |

(52) U.S. Cl.

CPC ..... *E05B 85/10* (2013.01); *E05B 17/0062* (2013.01); *E05B 77/02* (2013.01); *E05B 85/16* (2013.01); *Y10T 29/49826* (2015.01); *Y10T 292/57* (2015.04)

(58) Field of Classification Search

CPC ..... E05B 85/10; E05B 85/14; E05B 85/16; E05B 85/18; E05B 77/02; E05B 77/04; E05B 77/06; E05B 77/10; E05B 17/0062; E05B 17/0066

USPC ..... 292/336.3, DIG. 22, DIG. 16, DIG. 65

See application file for complete search history.

(56) References Cited

U.S. PATENT DOCUMENTS

| | | | | |
|---|---|---|---|---|
| 4,924,582 | A * | 5/1990 | Keller | 29/434 |
| 7,111,880 | B2 | 9/2006 | Saitoh | |
| 7,152,893 | B2 | 12/2006 | Pudney | |
| 7,481,468 | B2 | 1/2009 | Merideth et al. | |
| 8,038,185 | B2 | 10/2011 | Wood | |
| 2004/0251693 | A1* | 12/2004 | Schoen et al. | 292/1 |
| 2007/0029835 | A1* | 2/2007 | Herline et al. | 296/146.1 |
| 2010/0019512 | A1* | 1/2010 | Gschweng et al. | 292/217 |
| 2010/0109350 | A1* | 5/2010 | Gschweng et al. | 292/196 |
| 2011/0062747 | A1* | 3/2011 | Teramoto | E05B 77/04 296/146.1 |
| 2011/0115251 | A1 | 5/2011 | Jordan et al. | |
| 2011/0115252 | A1 | 5/2011 | Higgins et al. | |
| 2013/0146382 | A1* | 6/2013 | Schoen | 180/281 |

* cited by examiner

*Primary Examiner* — Alyson M Merlino

(74) *Attorney, Agent, or Firm* — Jason C. Rogers; Price Heneveld LLP

(57) ABSTRACT

A handle for doors of motor vehicles includes an outer portion that can be grasped by a user, and an inwardly-extending plunger or hook that operably interconnects the handle to the door latch via a bell crank (that is part of the handle base or chassis depending on the type of handle architecture used). The plunger is made of a ductile material such as metal, and includes a crumple zone that causes the plunger to deform axially and/or bend sidewardly in the event an axial and/or a bending impact load.

20 Claims, 10 Drawing Sheets

DEFORMABLE OUTSIDE HANDLE REAR HOOK OR PLUNGER

FIELD OF THE INVENTION

The present invention generally relates to a handle for vehicle doors, and more specifically to a vehicle door handle having a collapsible plunger or rear hook that absorbs energy during impact.

BACKGROUND OF THE INVENTION

A known type of door handle for motor vehicles generally includes a smoothly curved outer portion that can be grasped by a user. The door handle also includes a plunger that extends inwardly, transverse to the graspable portion of the handle. The plunger connects the main handle body to a bell crank, and transfers motion of the handle along an arc (curvilinear) during opening of the door into a rotation of the bell crank, which in turn holds a cable to release a door latch.

During a side impact with a pole or another vehicle impacting the vehicle directly at the door handle, the door handle may fracture and the intruding object e.g. pole or another vehicle can crush the door structure) toward the passenger compartment, with the handle plunger remaining intact with the rear portion of the handle. The handle plunger can transfer compressive force to the door inner panel which is not desirable. One aspect of the present invention is a solution in the form of a deformable metal plunger at the rear end of the outside handle strap. The deformable metal plunger may be designed/engineered with a series of corrugations (deformation triggers) where it will bend/deform and absorb the incoming impact energy generated during a side impact/crash and it is therefore not transferred to the passenger compartment or the occupant in any form.

A deformable metal plunger with precisely engineered corrugations may be utilized. Metals are an example of a preferred material due to the ductility of metals and their ability to absorb large amounts of energy via deformation without fracturing. The present invention combines these material properties with an engineered crumple zone with corrugations that initiate bending/deformation at the desired level of impact energy. It will, however, be understood that the present invention is not limited to metal materials. Similarly, the present invention is also not limited to the specific corrugations described herein.

SUMMARY OF THE INVENTION

One aspect of the present invention is a handle (strap) assembly for a door of a motor vehicle. The handle assembly includes a main handle portion having a graspable portion including inward and outward sides and forward and rearward portions. A central portion extends between the forward and rearward portions. The front portion is configured to pivot about a generally upright axis, and the rear portion is connected to a bell crank. The bell crank may comprise a known component that moves in the door handle bracket/chassis/reinforcement mounted to a vehicle door outer panel to enable movement of the main handle portion between a rest position and an actuated position. At least the central portion is configured and shaped to be grabbed by a user. The handle assembly further includes an elongated portion extending transversely inwardly relative to the graspable portion to define a plunger, such that the handle is generally L-shaped in plan view. The plunger is configured to operably engage a bellcrank and the bellcrank is connected to the movable latch release member (outside release lever) via a release cable or other suitable component to thereby release a door latch upon movement of the handle from the rest position to the actuated position. The plunger has a base portion directly adjacent to rearward portion of the main handle portion, and an elongated distal portion extending from the base portion and defining an end. The base portion includes a plurality of crumple zones, and it also defines a first bending strength. The elongated distal portion defines a second bending strength that is significantly greater than the first bending strength, whereby a load acting on the end to bend and compress the plunger causes the plunger to deform and absorb energy at the crumple zones without significant deformation at the distal portion of the plunger.

Another aspect of the present invention is a vehicle door including a latch, and a handle operably connected to the latch. The handle has a polymer body having a gently curved graspable portion defining front and rear ends, and a separate transverse metal plunger attached to the main body of the handle using screws or other suitable attachment scheme. The deformable plunger including a plurality of waveform shapes forming corrugations that collapse upon subjecting the plunger to an axial load only or a combined axial and bending load whereby the plunger bends and absorbs energy without fracturing during impact. One aspect of the present invention is a deformable metal (due to ductility of metals and the ability of metals to absorb energy via deformation without fracturing) for the plunger to bend/deform and absorb the impact energy generated during a side impact/crash.

Yet another aspect of the present invention is a method of making a door handle. The method includes preforming an elongated tubular plunger from a ductile material. The method also includes forming a polymer handle having a smoothly curved graspable portion and forward and rearward ends. The method includes securing a base of the elongated tubular plunger to the rearward end of the polymer handle.

These and other aspects, objects, and features of the present invention will be understood and appreciated by those skilled in the art upon studying the following specification, claims and appended drawings.

BRIEF DESCRIPTION OF THE DRAWINGS

In the drawings:

FIG. 1;

FIG. 1;

FIG. 4;

FIG. 4;

FIG. 8;

DETAILED DESCRIPTION OF THE PREFERRED EMBODIMENTS

Figures 1, 2:
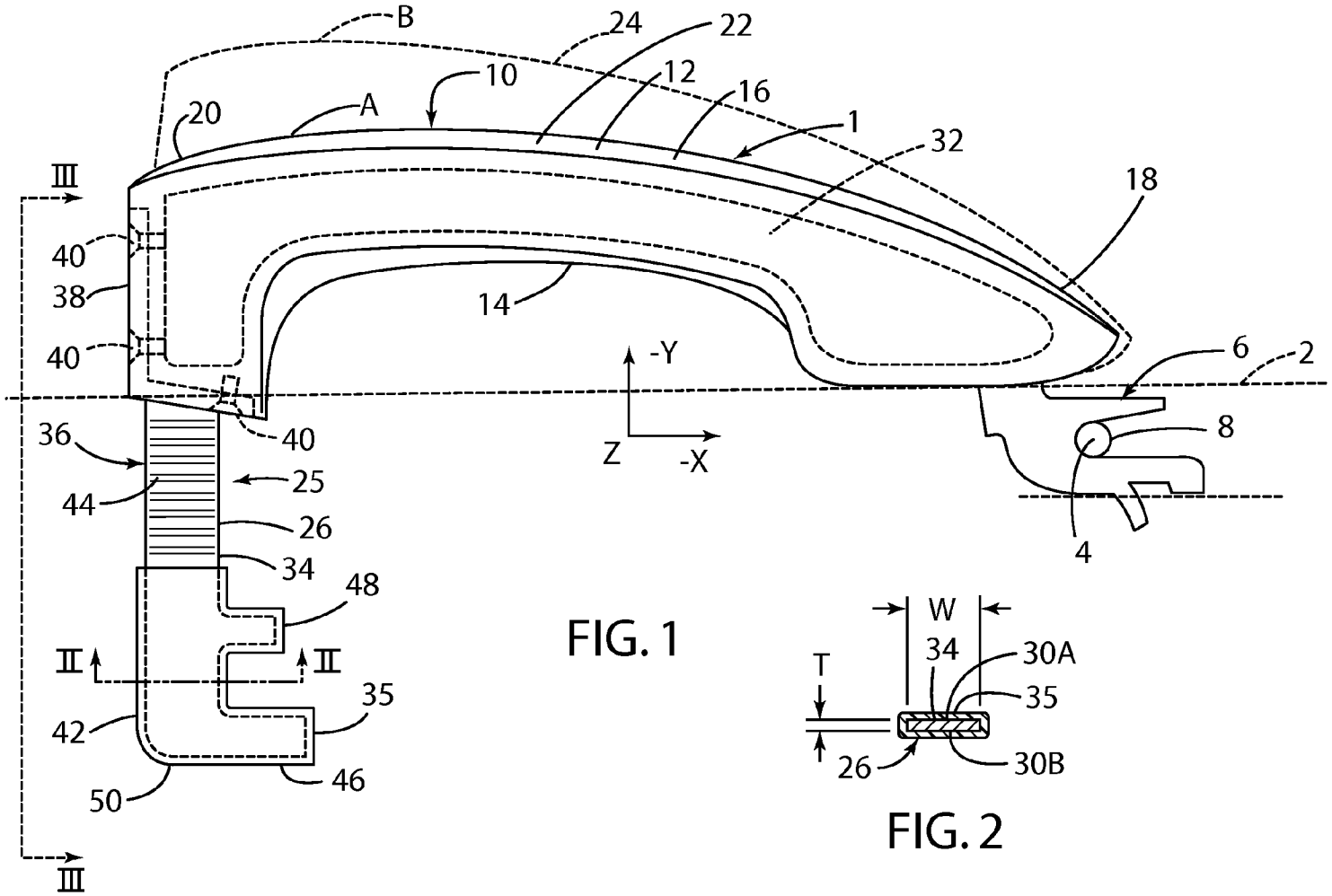
FIG. 1 is a plan view of a door handle assembly according to one aspect of the present invention.
FIG. 2 is a cross sectional view of the handle of FIG. 1 taken along the line II-II.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The handle architecture shown and described herein in connection with FIGS. 1-10 is generally known as a chassis-strap handle architecture. This type of system includes a moveable element called the handle (items 10, 10A, 10B, 10C & 10D), a non-moving element called the bezel (not shown) and finally a chassis (handle reinforcement also not shown). The chassis attaches to the door outer panel from inside the door and houses the moving components such as the spring actuated bell crank (not shown) and countermass and spring actuated inertia lock (not shown), lock cylinder housing and a spring actuated lock pawl (not shown). However, another aspect of the present invention is a "plant-on" handle (FIG. 11) in which the handle strap and housing/base are all integral forming a plant-on handle assembly and the entire plant-on handle assembly is assembled to the door outer panel from outside the vehicle. With reference to FIG. 1, a handle assembly 1 according to one aspect of the present invention is configured to be mounted to a vehicle door structure 2 by a front hook 6 for rotation about a generally vertical axis 4. The vertical axis 4 extends parallel to the Z coordinate shown in FIG. 1. The Main handle body 10 includes a graspable portion 12 having an inward side 14, and outward side 16, a forward portion 18, a rearward portion 20, and a central portion 22 extending between the forward portion 18 and rearward portion 20. The forward portion 18 includes front hook 6 for rotatably/movably mounting the main handle body 10 to a vehicle door structure 2. Front hook 6 and associated shafts or pins 8 providing rotation of door main handle body 10 are generally known in the art, such that the details of front hook 6 will not be described in detail herein. The handle body 10 moves between a rest position A and an actuated position B as shown by dashed lines 24 in FIG. 1.

An elongated portion 25 of handle body 10 extends transversely inward relative to the graspable portion 12 of main handle body 10 to define a plunger 26, such that the handle is generally L-shaped in plan view as shown in FIG. 1. The plunger 26 is configured to operably engage a movable latch release member (not shown) for release of a door latch. The movable latch release member may comprise a bellcrank and/or a cable, a link member, or other suitable device or structure. Cables, door latches, bellcranks, and other such connectors are known in the art, such that these components will not therefore be described in detail herein.

Main handle body 10 may be molded from a polymer material such as nylon, and may further comprise glass fibers. Handle body 10 may have a hollow interior 32. Plunger 26 is preferably made of a deformable material such as a ductile metal. Plunger 26 may comprise low-carbon steel, aluminum, or other suitable material. With reference to FIG. 2, the plunger 26 has a solid metal primary structure 34 (e.g. stamped sheet metal) having a rectangular cross-sectional shape with a typical width "W" of about 9 to about 15 mm, and a thickness "T" of about 1.25 to about 3 mm (Other W & T combinations outside of this range are possible but not typical). End portion 42 of plunger 26 may have a polymer sleeve 35 covering the metal primary structure 34. Polymer sleeve 35 may comprise Acetal and Teflon® to improve handle operational smoothness and reduce operating effort/friction between the handle and bell crank (not shown). A base portion 36 includes a mounting plate or bracket 38 (see also FIG. 3) that secures the plunger 26 to main handle body 10 by a plurality of threaded fasteners 40.

End portion 42 of plunger 26 is generally linear with planar opposite surfaces 30A and 30B (FIG. 2). A plurality of bends or corrugations 44 are formed in base portion 36 of plunger 26. The plunger 26 also includes a transversely extending end portion 46 forming a hook that can be utilized to interconnect to a cable (not shown) via a bell crank (not shown) or other linkage for actuation of a door latch (not shown) in a manner that is substantially similar to known hooks. Plunger 26 may include a secondary transverse backstop structure 48 which forms a U-shaped fork in which the bell crank finger (not shown) engages in a know manner. As the handle 10 is pulled, its motion is transferred to a rotational motion of the bell crank, which in turn transfers its rotational motion to the linear motion of the latch release cable (not shown) in a known manner. The latch release cable has one end connected to the bell crank and the other end connected to the outside release lever of the door latch.

Figure 3:
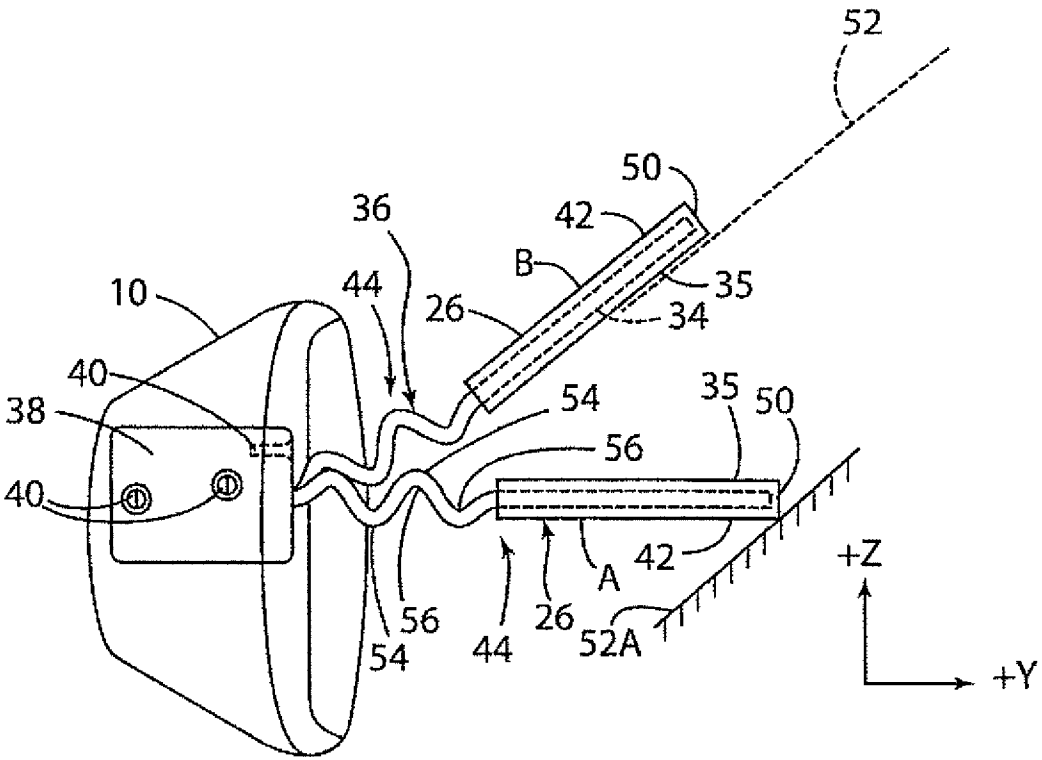
FIG. 3 is a view of the handle of FIG. 1 taken along the line III-III.

With reference to FIG. 3, during impact, end 50 of plunger 26 may contact an angled surface 52 of a vehicle door inner panel or door module baseplate. Surface 52 is formed by an inner reinforcing portion (also called an inner belt reinforcement) of door structure 2. The contact between end 50 of plunger 26 and surfaces 52 imparts an axial compressive load onto the plunger 26, and may also generate a side or bending load on plunger 26. The load on plunger 26 causes the bends or corrugations 44 to bend and deform such that the end portion 42 of plunger 26 rotates from the position designated "A" to the position designated "B" in FIG. 3. Bending of plunger 26 may cause plastic (i.e. permanent) deformation of the ductile material forming primary structure 34 of plunger 26. In the illustrated example, surface 52 angles upwardly, such that plunger 26 deforms upwardly as it is pushed into surface 52. However, surface 52 could have other configurations, such that plunger 26 is deformed downwardly, or forwardly or rearwardly, depending upon the requirements of a specific application. Furthermore, surface 52 may be flat, curved, etc. as required for a particular application. In FIG. 3, the reference frame is fixed to handle body 10 to show the deformation of plunger 26 relative to handle body 10. In FIG. 3, surface 52 is designated "52A" and shown in dashed lines to show engagement of surface 52 with end 50 of plunger 26 after plunger 26 is deformed due to an inward force acting on handle body 10.

Referring again to FIG. 3, corrugations 44 comprise a series of raised ridges 54 that alternate with grooves 56. Each bend or corrugation 44 forms a raised ridge 54 on one side of plunger 26 and a groove 56 on an opposite side of plunger 26. In the illustrated example, the plunger 26 has a generally rectangular cross-sectional sectional shape, and the raised ridges 54 and grooves 56 are formed by, for example, stamping the metal material used to form metal structure 34. The corrugations 44 in base portion 36 of plunger 26 may have a variety of configurations. In the illustrated example, the corrugations 44 have a sine wave shape and a generally uniform cross sectional shape that is substantially rectangular as shown in FIG. 2. However, corrugations 44 may have a variety of shapes/configurations.

The alternating raised ridges 54 and grooves 56 create an area that deforms in bending and/or compression such that the plunger 26 collapses and bends sideways as shown in FIG. 3 in the event a load acting in the Y direction (FIG. 1) is applied to handle body 10. However, plunger 26 is sufficiently strong under normal operation loads (i.e., when subject to axial tensile loads resulting from a user pulling on handle 10) to permit actuation of a door latch utilizing a cable and/or other linkage.

Figures 1A, 2A:
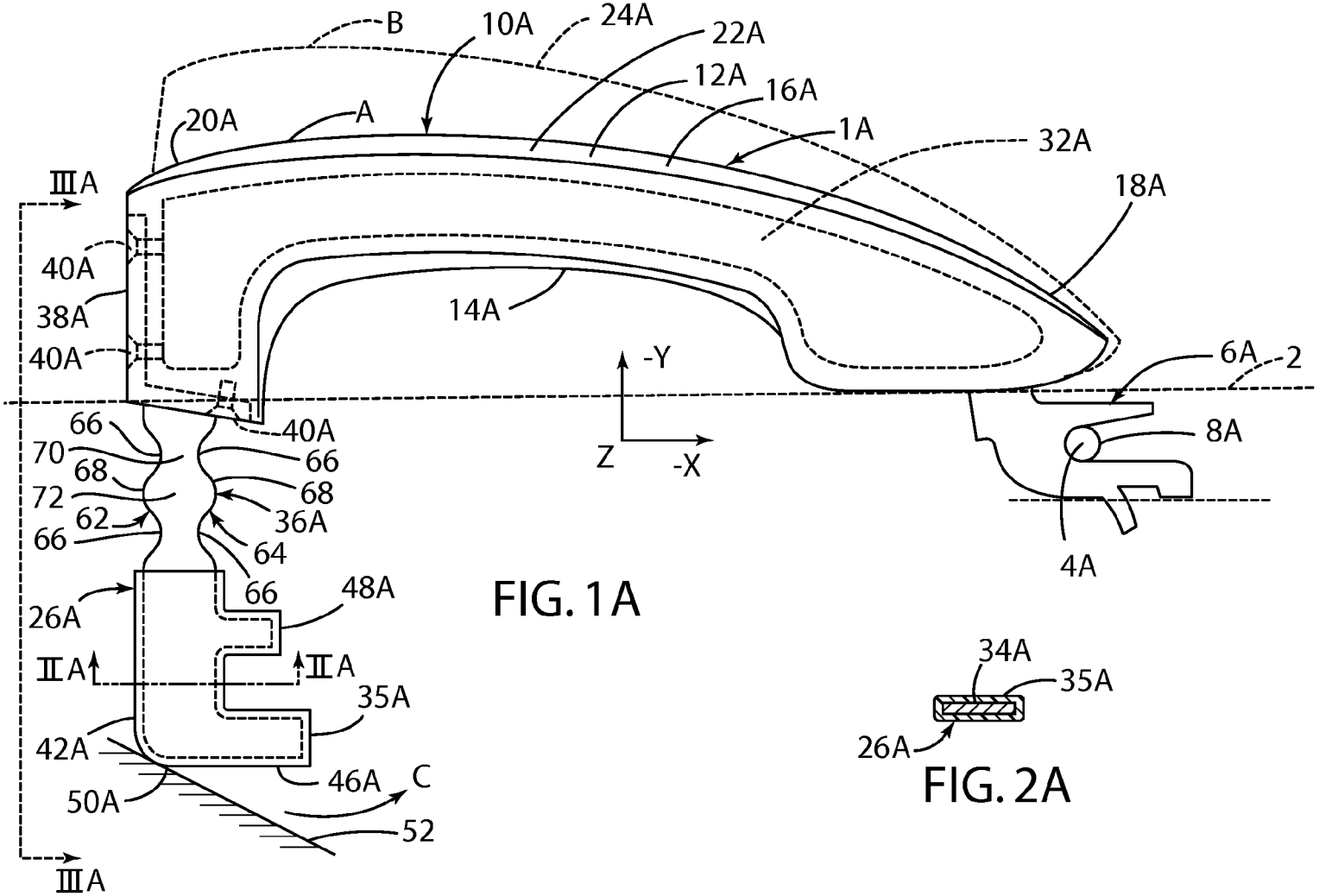
FIG. 1A is a plan view of a door handle assembly according to another aspect of the present invention.
FIG. 2A is a cross sectional view of the handle of FIG. 1A taken along the line IIA-IIA.
Figure 3A:
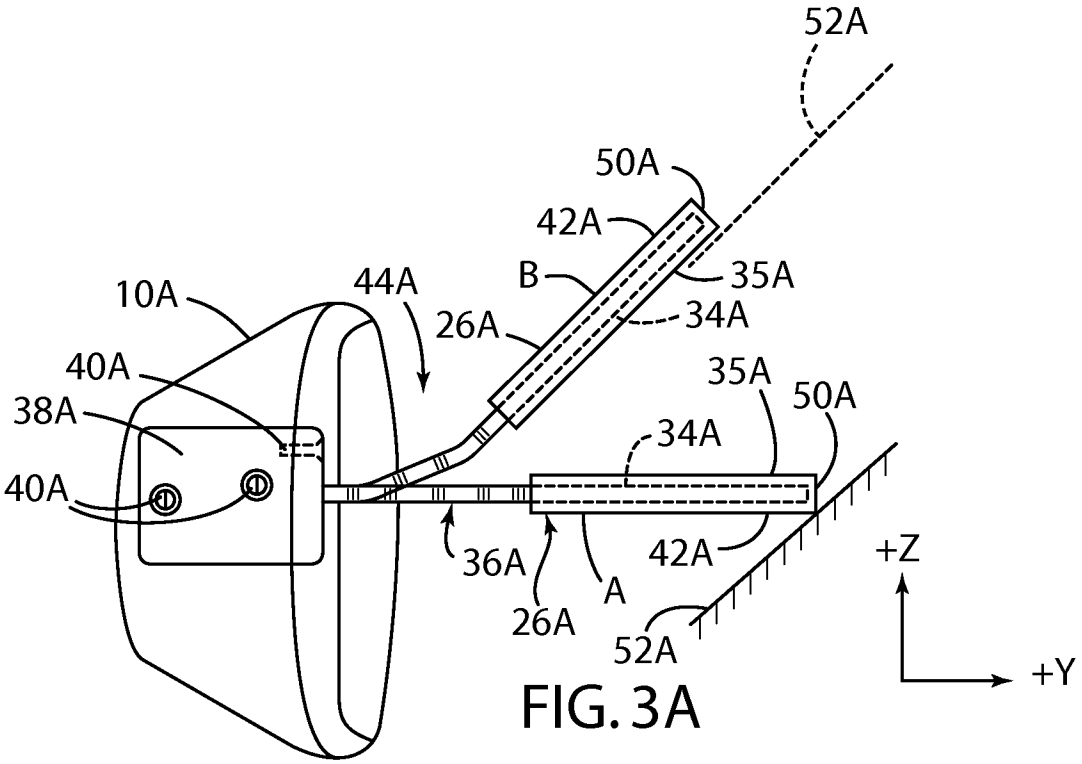
FIG. 3A is a view of the handle of FIG. 1A taken along the line IIIA-IIIA.

With further reference to FIGS. 1A, 2A and 3A, a handle assembly 1A according to another aspect of the present invention includes a main handle body 10A that is substantially similar to handle body 10 described in more detail above in connection with FIG. 1. Many of the features of handle 1A are substantially the same as handle 1, and corresponding features of handle 1A are therefore designated utilizing the same reference numbers as in FIGS. 1-3, except that the suffix "A" has been added to the reference numbers.

Handle assembly 1A includes a plunger 26A that is configured to engage a movable latch release member. Base portion 36A of plunger 26A is made from, for example, flat sheet metal (e.g. steel) having a generally rectangular cross sectional shape as shown in FIG. 2A. Base portion 36A includes opposite side edges 62 and 64 that are wavy or curved with concave portions 66 and convex portions 68. The concave portions 66 form narrow areas 70 in base portion 36, and the convex portions 68 form wider areas 72 in base portion 36A. In the illustrated example, the concave portions 66 and convex portions 68 of opposite side edges 62 and 64 have a shape that is similar to a sine wave. However, the opposite side edges 62 and 64 may have other shapes as required for a particular application. The narrow areas 70 have a reduced cross sectional area and therefore have less strength in axial loading and in bending.

With reference to FIG. 3A, in the event main handle body 10A is driven towards surface 52 due to an impact or the like, end 50A of plunger 26A will be pushed sideways by surface 52, thereby causing bending at base portion 36A of plunger 26A. The plunger 26A tends to deform and bend in the narrow areas 70 of base 36A due to the reduced stiffness/strength of the narrow (necking down) areas 70. The surface 52 may be configured to cause the plunger 26A to move in the Y-Z plane and deform in the manner shown in FIG. 3A, or the surface 52 may be angled such that the end 50A moves in the X-Y plane as shown by the arrow "C" in FIG. 1A. Surface 52 may also have a compound angle (e.g. a combination of the angles shown in FIGS. 1A and 3A.

Figures 4, 6:
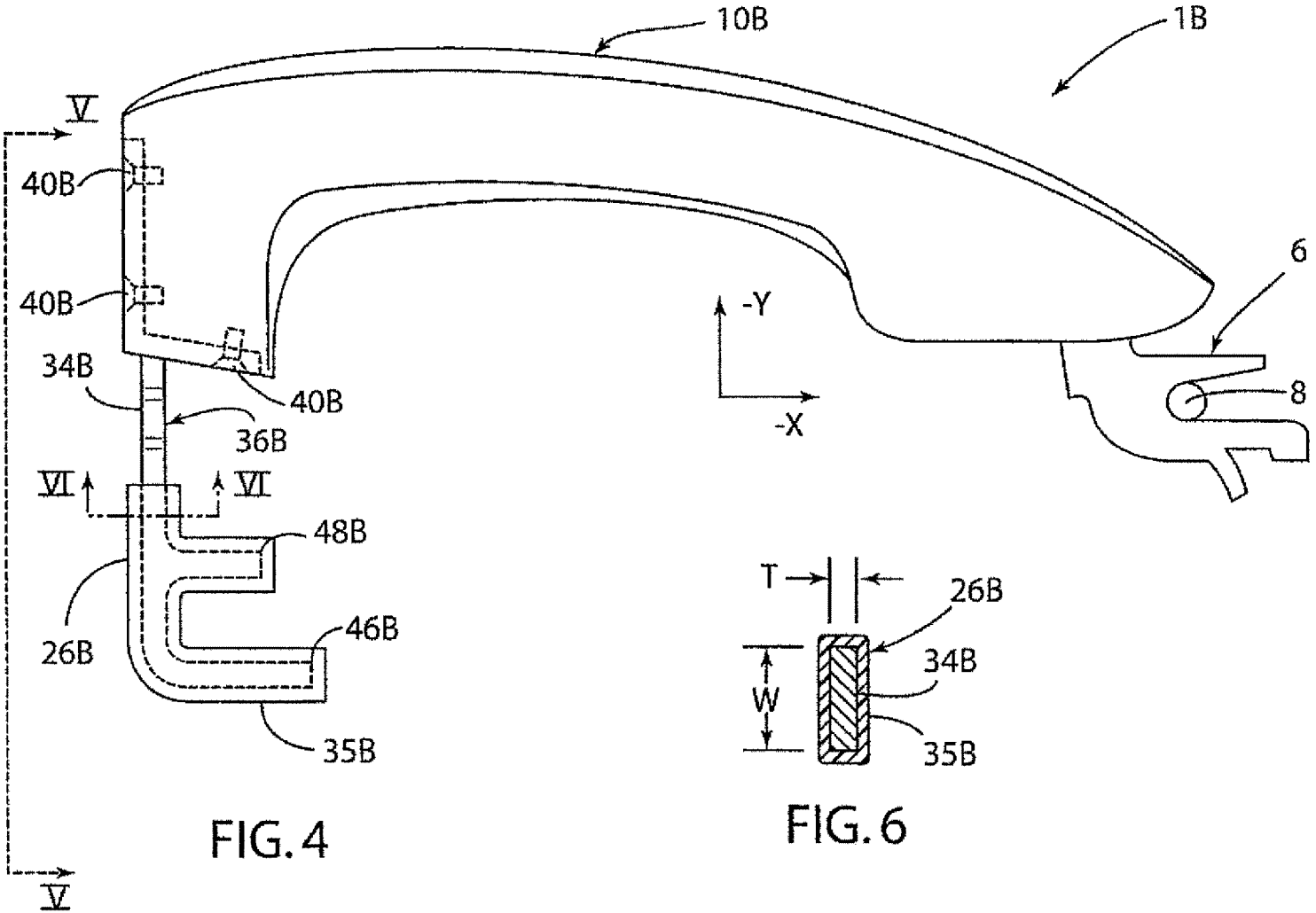
FIG. 4 is a plan view of a door handle assembly according to another aspect of the present invention.
FIG. 6 is a view of the door handle of FIG. 4 taken along the line VI-VI.
Figure 5:
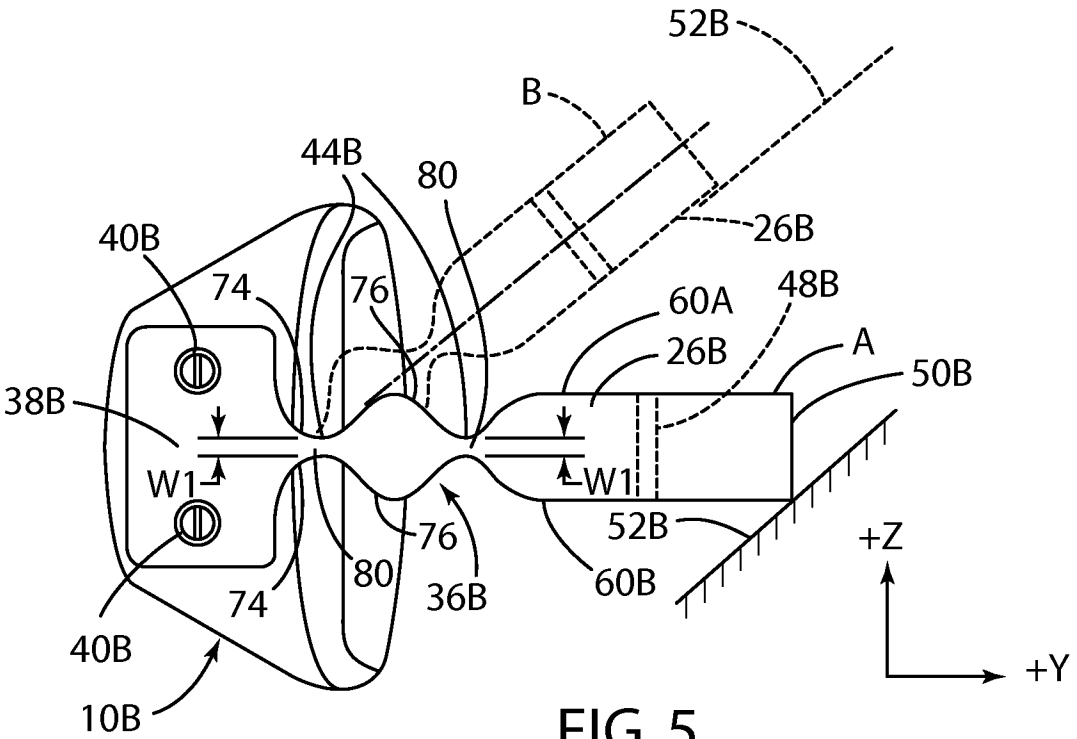
FIG. 5 is a view of the door handle of FIG. 4 taken along the line V-V.

With further reference to FIGS. 4-6, a handle assembly 1B according to another aspect of the present invention includes a main handle body 10B that is substantially similar to the main handle body 10 described in more detail above in connection with FIGS. 1-3. Plunger 26B includes a metal primary structure 34B (FIG. 5) that may be covered by a polymer sheath 35B. Sheath 35B is preferably made of Acetel and Teflon®. Sheath 35B improves handle operational smoothness and reduces operating effort that would otherwise be required due to friction between the plunger 26 and a bell crank (not shown). Plunger 26B has a generally rectangular cross-sectional shape (FIG. 6) with relatively large curved portions or corrugations 44B on opposite side edges 60A, 60B of plunger 26B. The opposite side edges 60A and 60B of base portion 36B of plunger 26B include concave portions 74 and convex portions 76 that are positioned opposite one another to form areas 80 (FIG. 5) having reduced cross-sectional area. Areas 80 have a width "Wl" of about 2.0-3.0 mm, and more preferably about 2.5 mm. The other (wider) portions of plunger 26B have a width "W" (FIG. 6) of about 15.0 mm, and a thickness "T" of about 1.2-3.0 mm. It will be understood that these dimensions may be greater or smaller depending upon the material utilized to form main structure 34B, the shape/configuration of surface 52, and other factors of a particular handle design. Concave and convex portions 74 and 76, respectively or corrugations 44B may be formed by cutting or otherwise forming the flat sheet metal material used to form plunger 26B. The plunger 26B may include a transversely extending end portion 46B forming a hook, a secondary transverse backstop structure 48B, and a bracket or base portion 38B that is connected to the main handle body 10A by threaded fasteners 40B.

Areas 80 have reduced axial and bending strength/stiffness, thereby forming a crumple zone that deforms/bends if end 50B contacts angled surface 52B of door structure 2. During impact, a compressive and/or bending force is generated as end 50B contacts surface 52B, thereby causing the corrugations or undulations 44B to collapse and deform at narrow areas 80 such that the end 50B of plunger 26B is deflected in the Z direction rather than moving solely in the Y direction. Surface 52B may comprise an interior reinforcing structure of a vehicle door structure 2 that is formed at an angle to facilitate collapse/bending of plunger 26B.

Figure 7:
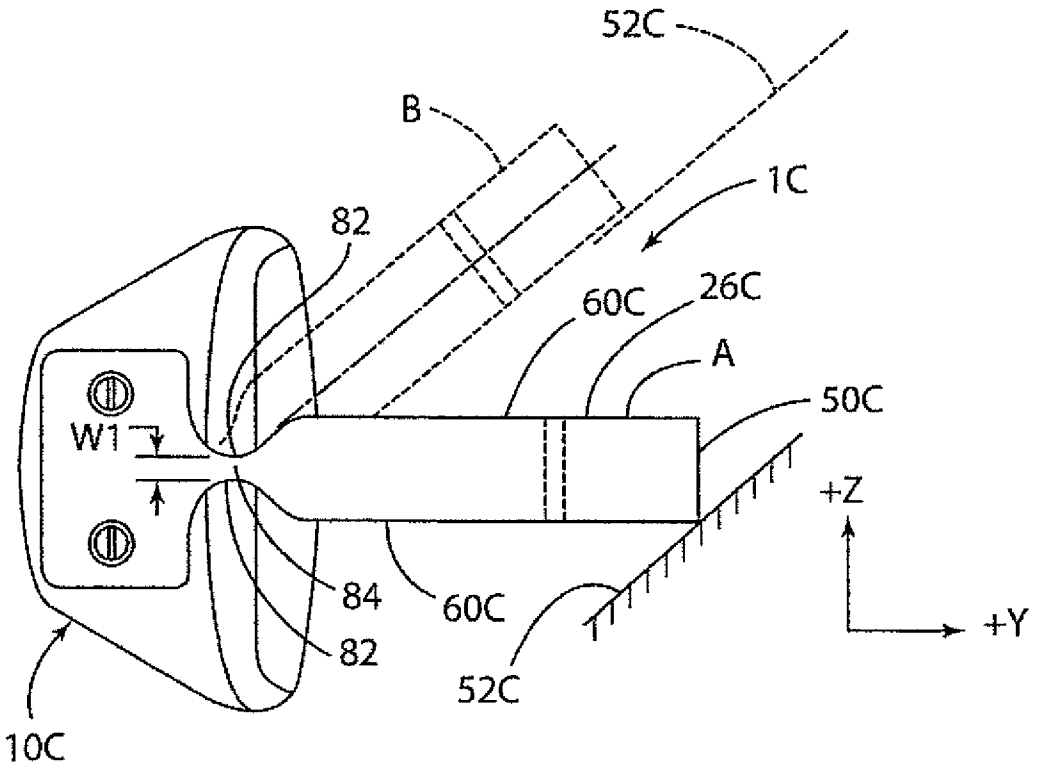
FIG. 7 is a partially schematic view of a door handle according to another aspect of the present invention.

With further reference to FIG. 7, a handle 1C is somewhat similar to the handle 1B of FIG. 6. As discussed above, the handle 1B includes two corrugations 44B on each side 60 of plunger 26B forming two narrow areas 80 having reduced cross-sectional area. In contrast, plunger 26C of handle 1C includes a single undulation formed by a single convex edge portion 82 on each opposite side 60C of plunger 26C forming a single area 84 of reduced cross-sectional area. If end 50C of plunger 26C contacts surface 52C of a vehicle door, plunger 26C will tend to bend at narrow area 84. The shape/configuration of surface 52C and the reduced strength of plunger 26C at area 84 ensures that plunger 26C deforms at a predetermined location in a predetermined manner in the event a force is applied to handle body 10.

Figures 8, 9:
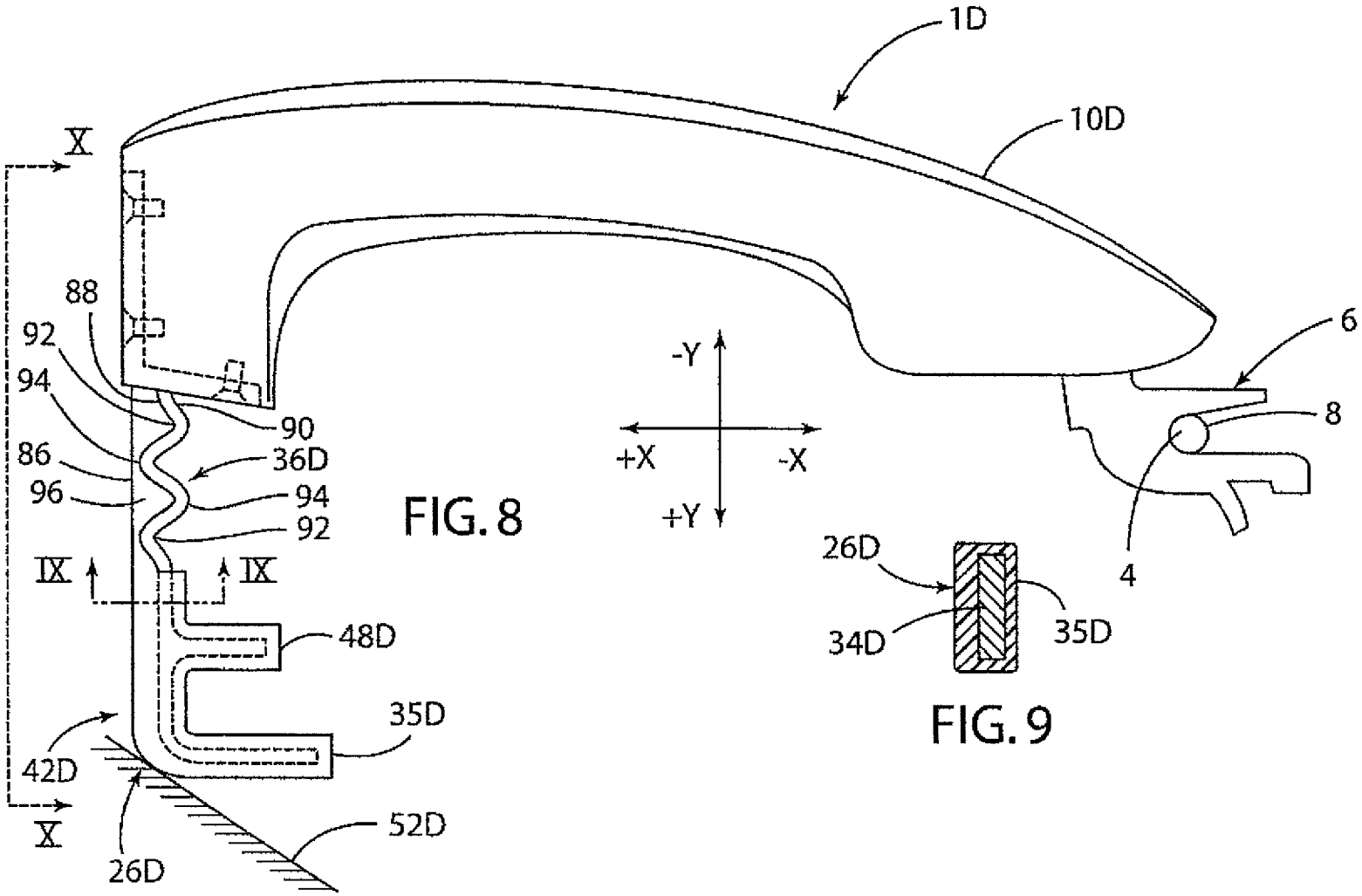
FIG. 8 is a plan view of a door handle assembly according to another aspect of the present invention.
FIG. 9 is a cross sectional view of the door handle of FIG. 8 taken along the IX-IX.
Figure 10:
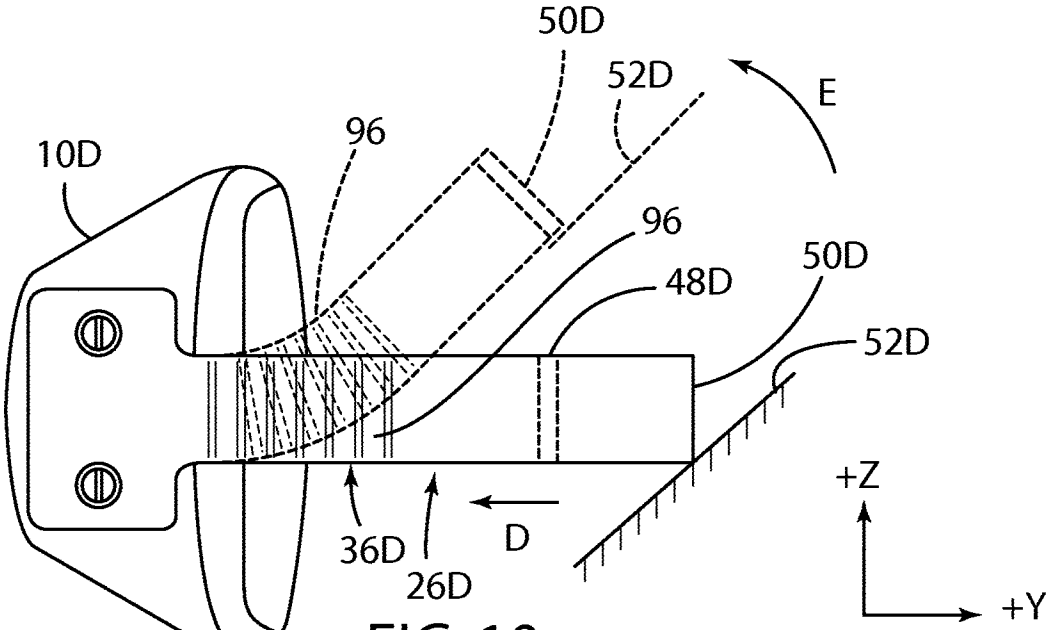
FIG. 10 is a view of the door handle of FIG. 8 taken along the line X-X.

With further reference to FIG. 8-10, a handle assembly 1D according to another aspect of the invention includes a handle body 10D that is substantially similar to the handle body 10 described in more detail above in connection with FIG. 1. Handle 1D includes a plunger 26D having a primary structure 34D that may be made from metal or other deformable material. A polymer sleeve 35D encapsulates end portion 42D of plunger 26D. Plunger 26D may include a secondary transverse backstop structure 48D. The polymer sleeve 35D includes a portion 86 covering outer side 88 of base portion 36D of plunger 26D. Outer side 88 and inner side 90 of base portion 36D include a plurality of concave surface portions 92, and a plurality of convex surface portions 94. The concave and convex surface portions 92 and 94 may be in the form of a sine wave or other suitable shape. The concave and convex surfaces 92 and 94 form a plurality of corrugations 96 having reduced bending and/or axial strength.

With reference to FIG. 10, in the event the handle body 10D is subject to a force upon contact with surface 52D, end 50D of plunger 26D contacts surface 52D and is driven inwardly in the direction of the arrow "D" and/or the end 50D will deflect or bend in the direction of the arrow "E." For example, the end 50D may initially be compressed axially in the direction of the arrow D to thereby shorten the plunger 26D, and the plunger 26D may then bend in the direction of the arrow E.

Figure 11:
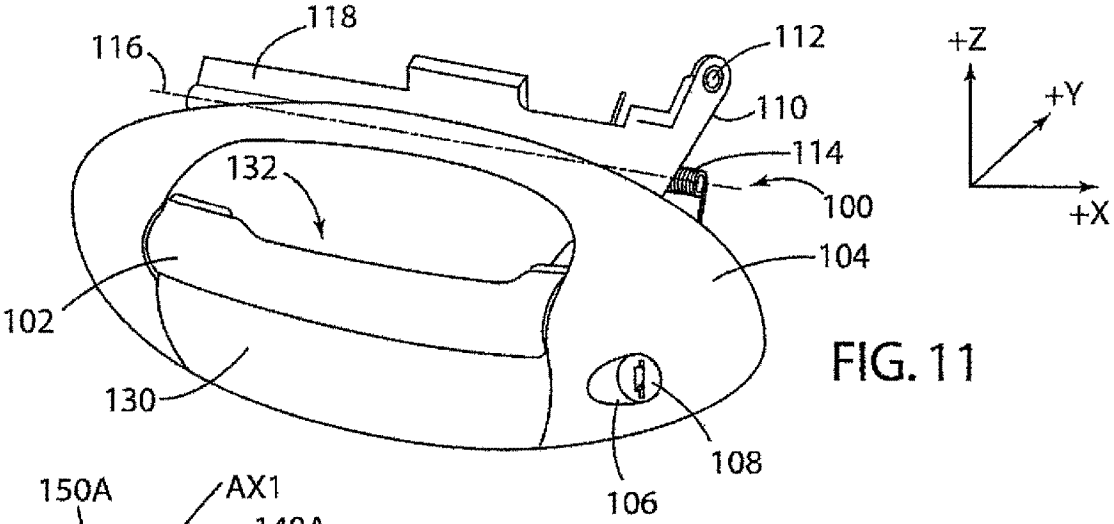
FIG. 11 is an isometric view of a door handle having a pair of deformable plungers according to another aspect of the present invention.

With further reference to FIG. 11, a handle assembly 100 according to another aspect of the present invention includes a handle strap 102 and a handle base 104. The handle base 104 is preferably the same color as the body of a motor vehicle, and defines a keyhole 106 that receives a key cylinder 108. The handle base 104 may be substantially similar to known designs.

The handle assembly 100 includes a bell crank 110 having an attachment feature such as an opening 112 that provides for connection to a release rod or cable (not shown) in a known manner. The handle assembly 100 may also include a counter mass 118 that counteracts the affects of the other moving components in the system, During normal operation, a user pulls outwardly on handle strap 102, thereby rotating bell crank 110 about axis 116 to release the door latch. A bell crank spring 114 biases bell crank 110 towards a home or rest position in a known manner. The operation of handle strap 102, bell crank 110, counter mass 118, and other related components may be substantially similar to known designs, such that these components are not described in detail herein.

Figure 12:
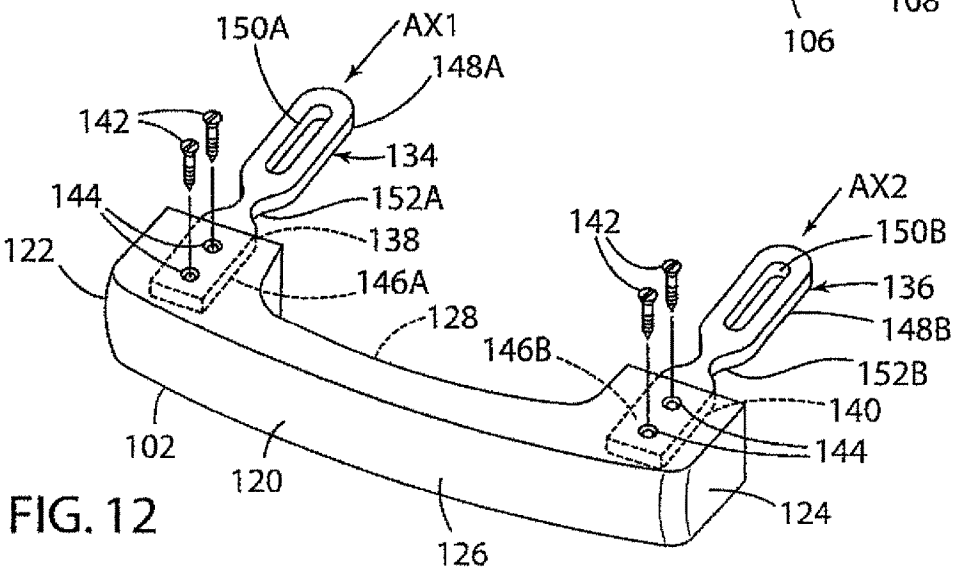
FIG. 12 is an isometric view of a handle strap and plungers of the handle assembly of FIG. 11.

With further reference to FIG. 12, handle strap 102 comprises a handle body 120 that may be made from a polymer material, metal materials, or other suitable materials. The handle body 120 includes a front end portion 122, rear end portion 124, and a central portion 126 extending between the front and rear portions 122 and 124, respectively. The handle body 120 includes a smoothly curved inner surface 128 that faces a recess or pocket 130 (FIG. 11) formed in handle base 104 to thereby form a gap or space 132 having sufficient size to permit insertion of a user's fingers between surfaces 128 and 130.

Referring again to FIG. 12, handle strap 102 includes a front plunger 134, and a rear plunger 136. The plungers 134 and 136 are received in slots or cavities 138 and 140, respectively in handle body 120, and fasteners such as self-tapping screws 142 extend through openings 144 in handle body 120 to thereby secure the plungers 134 and 136 to the handle body 120. It will be understood that the plungers 134 and 136 and handle body 120 may be interconnected in various ways.

Plungers 134 and 136 include base portions 146A and 146B, respectively that are received in slots or cavities 138 and 140 of handle body 120. The front and rear plungers 134 and 136 also include outer end portions 148A and 148B having elongated slots 150A and 150B formed therein. The slots 150A and 150B are configured to operably engage bell crank 110 in a known manner to release a door latch mechanism. Plungers 134 and 136 also include regions of reduced strength 152A and 152B, respectively. The regions 152A and 152B have a reduced cross sectional area relative to the base portions 146A and 146B, and the outer end portions 148A and 148B, respectively. The plungers 134 and 136 are preferably made of a ductile metal material, such that one or both of the plungers 134 and 136 collapse if an axial force "AX1" and/or "AX2" are applied to the plungers 134 and/or 136 due to an external force acting on handle body 120. The regions of reduced strength 152A and 152B also provide for bending/collapse of plungers 134 and 136 in the event a bending force or axial is applied to the plungers 134 and/or 136. It will be understood that the regions of reduced strength 152A and 152B may also comprise corrugations, undulations, or other suitable geometries that provide for reduced axial and/or bending strength of plungers 134 and 136.

In the embodiments described above, the plunger includes a primary structure formed of a ductile material such as metal, and the structure has a generally rectangular cross-sectional shape. However, the plunger could have other cross-sectional shapes (e.g. square, round, oval, etc.). Furthermore, the plunger could have a tubular construction with corrugations formed in one or more sidewalls of the tube to form a crumple zone that bends and/or axially compresses in the event the door handle is subject to an inwardly-acting force.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A handle assembly for a door of a motor vehicle, the handle assembly comprising:

a bell crank configured to be rotatably mounted to a vehicle door;

a main handle portion having a graspable portion including inward and outward sides and forward and rearward portions, and a central portion extending between the forward and rearward portions, wherein the main handle portion is configured to be movably mounted to the vehicle door for outward movement of the main handle portion between a rest position and an actuated position, and wherein at least the central portion is configured and shaped to be grasped by a user;

an elongated portion fixed to the main handle portion and extending transversely inwardly relative to the graspable portion to define a plunger having an outer portion that is configured to move outward with the outward movement of the main handle portion so as to move away from an outer surface of the vehicle door, wherein the plunger engages and rotates the bell crank as the main handle portion is moved outwardly to thereby release a door latch upon movement of the handle from the rest position to the actuated position; and wherein:

the plunger has a base portion adjacent the rearward portion of the main handle portion, and an end portion extending from the base portion and defining an end, the base portion including at least one crumple zone defining a first bending strength, the end portion defining a second bending strength that is significantly greater than the first bending strength, whereby when the main handle portion is in the rest position, a load acting on the end to bend the plunger causes the plunger to deform and absorb energy at the at least one crumple zone.

2. The handle assembly of claim 1, wherein:

the base portion of the plunger has a solid cross-sectional configuration.

3. The handle assembly of claim 2, wherein:

the end portion of the plunger has a first cross-sectional area; and the at least one crumple zone comprises at least one area having a second cross sectional area that is significantly less than the first cross-sectional area.

4. The handle assembly of claim 3, wherein:

the base portion of the plunger includes opposite side surfaces having concave surface portions forming the at least one crumple zone.

5. The handle assembly of claim 2, wherein:

the base portion of the plunger comprises a ductile metal.

6. The handle assembly of claim 2, wherein:

the base portion of the plunger has a generally uniform cross-sectional shape.

7. The handle assembly of claim 6, wherein:

the base portion of the plunger includes a plurality of concave and convex surface portions on opposite sides of the base portion of the plunger.

8. The handle assembly of claim 7, wherein:

the base portion of the plunger is shaped such that it forms a plurality of sine waves which form the at least one crumple zone.

9. The handle assembly of claim 1, wherein:

the plunger comprises a rear plunger, and the handle assembly further comprises a front plunger:

having a base portion adjacent the forward portion of the main handle portion and an end portion extending from the base portion, the base portion of the rear plunger including at least one crumple zone defining a bending strength that is significantly less than a bending strength of the end portion of the front plunger.

10. A vehicle door comprising:

a bell crank;

a latch;

a movable handle operably connected to the latch; and the handle having a polymer body having front and rear ends and a transverse plunger rigidly cantilevered to the polymer body so as to move with the handle, engaging and rotating the bell crank, the plunger including corrugations that collapse upon subjecting the plunger to a load whereby the plunger bends and absorbs energy during impact.

11. The vehicle door of claim 10, wherein:

the plunger has a rectangular shape in cross section.

12. The vehicle door of claim 11, wherein:

the plunger defines an axis and a tip portion that extends transverse relative to the axis.

13. The vehicle door of claim 12, wherein:

the polymer body is hollow and defines an interior space.

14. The vehicle door of claim 13, including:

a plurality of threaded fasteners connecting the plunger to the polymer body.

15. A method of making a handle, comprising:

forming a plunger having a base and an F-shaped distal end configured to engage a bell crank;

forming a movable handle having forward and rearward ends; and rigidly fixing the base of the plunger to the rearward end of the handle in a cantilevered manner whereby the plunger moves with the handle, the plunger having a crumple zone with reduced bending strength adjacent the base.

16. The method of claim 15, wherein:

the plunger is formed from a metal material.

17. The method of claim 16, wherein:

forming the plunger includes forming the crumple zone with a plurality of regions having reduced cross-sectional area adjacent the base.

18. The method of claim 17, wherein:

forming the plunger includes forming the crumple zone with a plurality of raised ridges and grooves, the grooves forming the plurality of regions having reduced cross-sectional area adjacent the base of the plunger.

19. The handle assembly of claim 1, wherein:

the main handle portion and the plunger are rigidly interconnected such that the main handle portion and the plunger together form an L shape in plan view.

20. The method of claim 15, wherein:

the plunger is rigidly fixed to the handle such that the handle and the plunger together form an L-shape in plan view.

* * * * *